US008648763B2

(12) United States Patent
Choi et al.

(10) Patent No.: US 8,648,763 B2
(45) **Date of Patent: *Feb. 11, 2014**

(54) GROUND RADIATOR USING CAPACITOR

(75) Inventors: Hyeng-cheul Choi, Seoul (KR); Yang Liu, Seoul (KR); Oul Cho, Suwon-si (KR); Hyun min Jang, Jecheon-si (KR)

(73) Assignee: Radina Co., Ltd, Seoul (KR)

( * ) Notice: Subject to any disclaimer, the term of this patent is extended or adjusted under 35 U.S.C. 154(b) by 229 days.

This patent is subject to a terminal disclaimer.

(21) Appl. No.: 13/081,104

(22) Filed: Apr. 6, 2011

(65) Prior Publication Data

US 2011/0193757 A1 Aug. 11, 2011

Related U.S. Application Data

(63) Continuation of application No. PCT/KR2010/009340, filed on Dec. 24, 2010.

(30) Foreign Application Priority Data

| | | |
|---|---|---|
| Feb. 11, 2010 | (KR) | 10-2010-0012775 |
| Apr. 9, 2010 | (KR) | 10-2010-0032922 |
| May 7, 2010 | (KR) | 10-2010-0043186 |
| May 7, 2010 | (KR) | 10-2010-0043189 |
| May 7, 2010 | (KR) | 20-2010-0043190 |
| Jun. 14, 2010 | (KR) | 10-2010-0056207 |
| Dec. 23, 2010 | (KR) | 10-2010-0133923 |

(51) Int. Cl.
*H01Q 1/48* (2006.01)

(52) U.S. Cl.
USPC ..... 343/845; 343/846; 343/847

(58) Field of Classification Search
USPC ..... 343/845–847
See application file for complete search history.

(56) References Cited

U.S. PATENT DOCUMENTS

| | | | | |
|---|---|---|---|---|
| 8,581,799 | B2 | 11/2013 | Choi et al. | |
| 2004/0095280 | A1 * | 5/2004 | Poilasne et al. | 343/702 |

FOREIGN PATENT DOCUMENTS

| | | | |
|---|---|---|---|
| EP | 1962372 | A1 | 8/2008 |
| KR | 10-2006-0017281 | A | 2/2006 |
| KR | 10-2007-0112169 | A | 11/2007 |
| KR | 10-2009-0017964 | A1 | 2/2009 |
| KR | 10-2009-0030116 | A | 3/2009 |
| KR | 10-1003014 | A | 12/2010 |

OTHER PUBLICATIONS

U.S. Office Action in U.S. Appl. No. 13/081,014 dated Mar. 29, 2013.
U.S. Office Action in U.S. Appl. No. 13/081,063 dated Mar. 28, 2013.
International Search Report in International Application No. PCT/KR2010/009338, dated Aug. 16, 2011.
International Search Report in International Application No. PCT/KR2010/009339, dated Aug. 16, 2011.
International Search Report in International Application No. PCT/KR2010/009340, dated Aug. 16, 2011.
U.S. Office Action in U.S. Appl. No. 14/048,052 dated Nov. 15, 2013.

* cited by examiner

*Primary Examiner* — Kristy A Haupt
(74) *Attorney, Agent, or Firm* — Park, Kim & Suh, LLC

(57) ABSTRACT

A ground radiation antenna is disclosed. Herein, the ground radiation antenna provides a ground radiator inducing resonance by using the inductance of a ground. Since the ground radiator efficiently uses the inductance of the ground, the ground radiator may operate as a radiator of the ground radiation antenna by using a simple structure of combining a capacitive element with the ground. As described above, by providing an antenna radiator having a remarkably simple structure, the fabrication cost for the antenna may be decreased, and the size of the antenna may also be largely reduced.

12 Claims, 6 Drawing Sheets

GROUND RADIATOR USING CAPACITOR

CROSS REFERENCE TO PRIOR APPLICATIONS

This application claims the benefit under 35 U.S.C. §120 and §365(c) to a prior PCT International Patent Application No. PCT/KR2010/009340 (filed on Dec. 24, 2010 and designating the U.S.), which claims priority to Korean Patent Application Nos. 10-2010-0012775 (filed on Feb. 11, 2010), 10-2010-0032922(filed on Apr. 9, 2010), 10-2010-0043186 (filed on May 7, 2010), 10-2010-0043189 (filed on May 7, 2010), 10-2010-0043190 (filed on May 7, 2010), 10-2010-0056207 (filed on Jun. 14, 2010) and 10-2010-0133923 (filed on Dec. 23, 2010), which are all hereby incorporated by reference in their entirety.

BACKGROUND OF THE INVENTION

1. Field of the Invention

The present invention relates to a ground radiator configuring a ground radiation antenna and, more particularly, to a ground radiator that can simplify the structure of the ground radiation antenna.

2. Related Art Technology

An antenna corresponds to a device that can receive RF signals existing in the air into a user terminal or to a device that can transmit signals existing within the user terminal to the outside. In other words, the antenna is an essential element used in wireless communication. Recently, the mobile telecommunication terminals are required to be compact in size, lightweight, and equipped with a slimmer antenna structure. Also, as the data size being transmitted and received through wireless communication has become larger, mobile telecommunication terminals are now required to be equipped with antennae providing greater performance.

Accordingly, the antenna using ground radiation of the user equipment itself has been proposed as a means to satisfy such demands. More specifically, when the antenna is configured by using the ground of the user equipment as a portion of the radiator, the size of the radiator, which occupies the largest amount of space within the antenna, may be largely reduced, thereby contributing to the compact size of the antenna.

As described above, the European Patent No. 1962372 corresponds to the related art ground radiation antenna using the ground of the user equipment as the radiator. This patent proposes a technology for designing an antenna by using the ground of a user equipment, when the main body of the user equipment is configured of two sub-bodies that can be separated from one another, such as a folder-type user equipment, and when each sub-body is connected to one another by an electrical device, such as the FPCB.

According to the above-mentioned European Patent, in a folder-type user equipment having the main body configured of two separate sub-bodies, a capacitor for tuning a resonance frequency within an electric conductor, which is provided for an inductive coupling, is inserted between the two sub-bodies.

Therefore, the above-described antenna is disadvantageous in that the antenna could only be used in a user equipment configured of two separate sub-bodies (i.e., folder-type user equipments or mobile terminals). Moreover, since the length of the electric conductor for the inductive coupling is pre-decided to have a constant length, the structure of the antenna becomes more complex, and the range of devices to which the above-described antenna can be applied is also very limited.

FIG. 1 illustrates a general view showing an exemplary structure of a related art ground radiation antenna.

Referring to FIG. 1, the related art ground radiation antenna 10 is equipped with a radiating element 11, which is provided to support and facilitate the ground radiation, as shown in FIG. 1. More specifically, the radiating element 11 corresponds to a complex structure, which is configured of dielectric substances and conductor lines. Therefore, a high fabrication cost and a complex fabrication process are required in order to fabricate this complex structure. Furthermore, in addition to the radiating element 11, the ground radiation antenna is also configured of inductors and capacitors 12*a*, 12*b*, and 12*c*, which are provided to perform impedance matching and radiating performance control.

Accordingly, although the related art ground radiation antenna uses the ground as the radiating element, the antenna is still required to be provided with a separate radiating element, which has a complex structure. Therefore, the related art ground radiation antenna is disadvantageous in that a large fabrication cost is required in order to implement the above-described radiating element. Furthermore, as the structure of the radiator of the antenna becomes more complex, there lies a limitation in creating more slim-sized user equipments.

Most particularly, due to a lack of understanding in the essential phenomenon of ground radiation, and also due to the use of an unnecessarily complex structure in order to realize ground radiation, the fabrication cost increases and the fabrication process becomes more complicated in the related ground radiation antenna.

SUMMARY OF THE INVENTION

Object of the Invention

An object of the present invention is to provide a ground radiator having a more simplified fabrication process, a slimmer antenna structure, and a remarkably reduced fabrication cost, by removing the radiating element having a complex structure, and by realizing the ground radiator using simpler elements.

Technical Solutions of the Invention

Another object of the present invention is to provide a ground radiator having a remarkably simple structure, by using the capacitance of a capacitor and the inductance of an inductor.

Additionally, a further object of the present invention is to provide a ground radiator, which is operated by using only a capacitive element, without any separate radiating element.

Effect of the Invention

Herein, the present invention may provide an antenna capable of ground radiation having a remarkably simple structure and showing excellent radiating performance. Furthermore, according to the present invention, by simplifying the structure of the radiator, the fabrication cost may be minimized, and the fabrication process may be more simplified.

DETAILED DESCRIPTION OF THE INVENTION

While repeatedly performing thorough research for realizing an improved version of a ground radiator showing excellent radiating performance while having a simpler structure from the related art ground radiation antenna, the present invention was devised based upon the essential principle of a ground radiating element, which enables ground radiation to occur.

In the related art antenna, efforts were made to enhance the radiation performance by separately equipping the antenna with a radiating element for ground radiation, and by varying the formation or structure of the radiating element. More specifically, efforts were made for realizing a radiator by combining an element having both inductance and capacitance with a capacitor and an inductor.

However, the applicant was able to discover that an excellent ground radiating element could be fabricated when using the inductance of the ground, by simply connecting the capacitor to the ground, without having to use a separate element configured of a complex structure.

In order to function as the radiating element of the antenna, the capacitor having the capacitance and the inductor having the inductance should both exist so as to create a resonance. The application also discovered that, since the ground provides the inductance required to generate the resonance, only the capacitor and the ground were required to perform the function of the radiating element without having to be equipped with a separate element for providing the inductance.

However, the related art ground radiators were incapable of efficiently using the inductance provided from the ground. And, accordingly, efforts were made in the related art in trying to generate resonance by configuring elements having a complex structure and being provided with both capacitance and inductance.

Conversely, according to the present invention, by being capable of efficiently using the inductance provided from the ground itself, resonance can be induced by a radiator having a simple structure may be configured to connect the capacitor to the ground.

Herein, although it was mentioned that only the inductance of the ground itself is used, more specifically, this indicates that most of the inductance exists within the ground. For example, the inductance may also exist in the conductor line that connects the capacitor to the ground.

Therefore, according to the present invention, the inductance of the ground signifies an inductance including both the inductance of the ground and the inductance of a conductor line.

Herein, although a capacitor having a general capacitive structure can be used on a ground printed circuit board, it is more preferable to use a chip capacitor.

Figure 1:
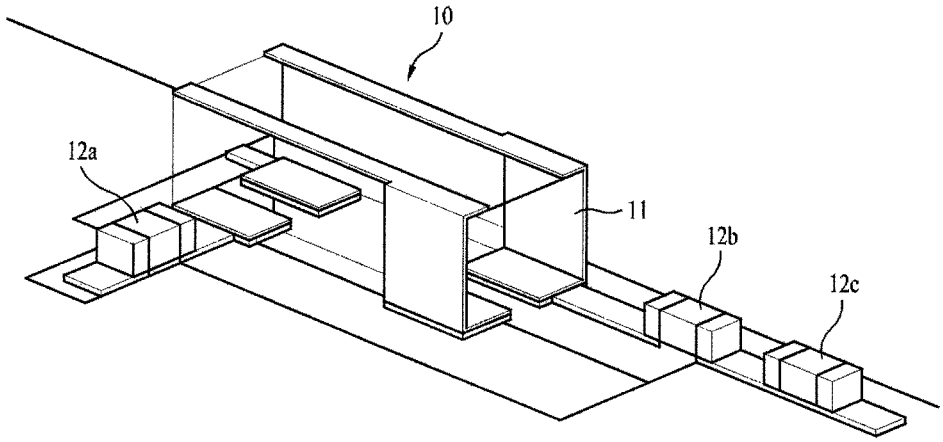
FIG. 1 illustrates a general view showing an exemplary structure of a related art ground radiation antenna.
Figure 2:
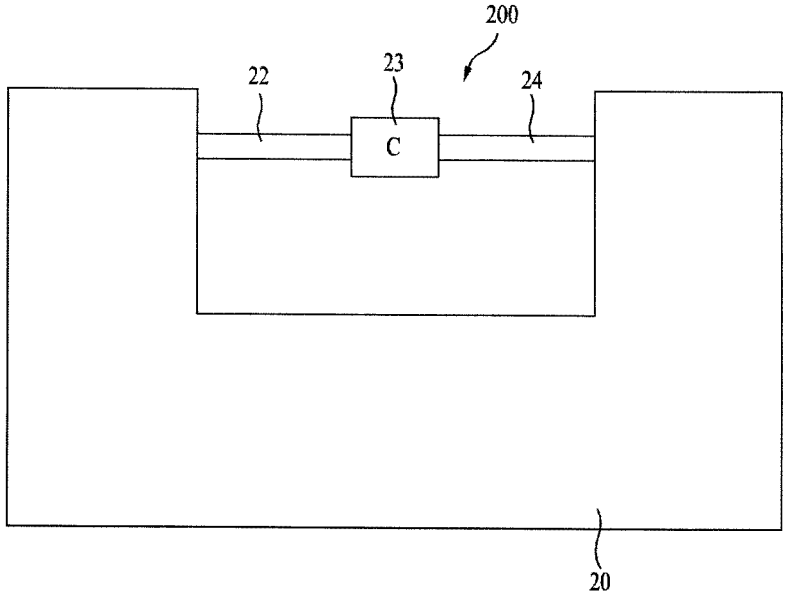
FIG. 2 illustrates a ground radiator according to a first embodiment of the present invention.

FIG. 2 illustrates a ground radiator according to a first embodiment of the present invention. As shown in FIG. 2, the ground radiator according to the first embodiment of the present invention includes a ground area 20, a first conductor line 22 connecting the ground area 20 to a capacitor 23, a capacitor 23, and a second conductor line 24 connecting the ground area 20 and the capacitor 23.

At this point, the first conductor line 22, the second conductor line 24, and the capacitor 23 are formed on a clearance area 200. Herein, the clearance area corresponds to an area within the user terminal ground having a portion of the ground removed therefrom.

According to the present invention, since a resonance frequency can be controlled by using the capacitance of the capacitor 23, an antenna being capable of easily controlling the resonance frequency and having the characteristic of a broadband may be provided.

Figure 3:
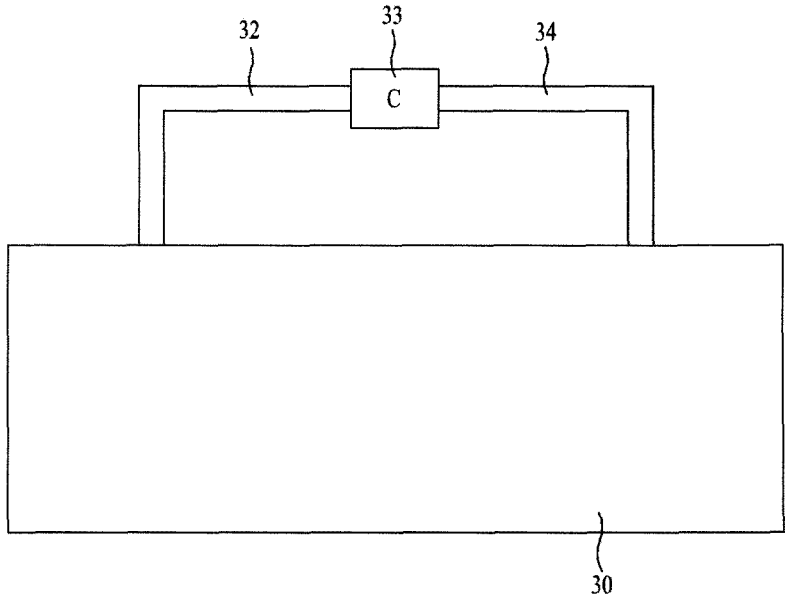
FIG. 3 illustrates a ground radiator according to a second embodiment of the present invention.

FIG. 3 illustrates a ground radiator according to a second embodiment of the present invention. As shown in FIG. 3, the ground radiator according to the second embodiment of the present invention includes a ground area 30, a first conductor line 32 connecting the ground area 30 to a capacitor 33, a capacitor 33, and a second conductor line 34 connecting the ground area 30 and the capacitor 33.

The second embodiment of the present invention relates to a structure of configuring the ground radiator without forming a clearance on a ground printed circuit board.

Figure 4:
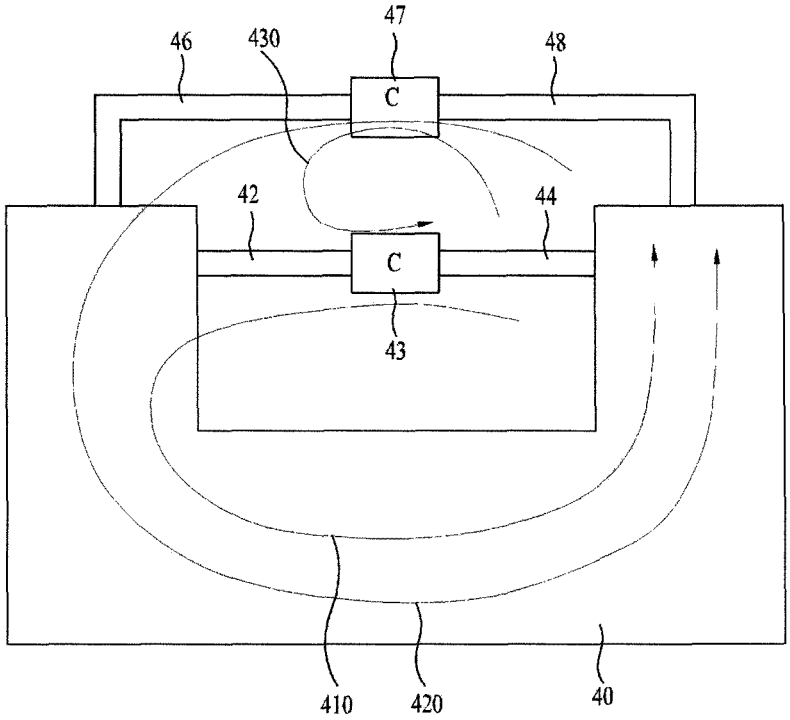
FIG. 4 illustrates a ground radiator according to a third embodiment of the present invention.

FIG. 4 illustrates a ground radiator according to a third embodiment of the present invention. As shown in FIG. 4, the ground radiator according to the third embodiment of the present invention includes a ground area 40, a first conductor line 42 connecting the ground area 40 to a first capacitor 43, a first capacitor 43, and a second conductor line 44 connecting the ground area 40 and the first capacitor 43. Such connection of the first capacitor 43 and the ground 40 may form a first electric current loop 410.

Alternatively, the ground radiator according to the third embodiment of the present invention includes a ground area 40, a third conductor line 46 connecting the ground area 40 to a second capacitor 47, a second capacitor 47, and a fourth conductor line 48 connecting the ground area 40 and the second capacitor 47. Such connection of the second capacitor 47 and the ground 40 may form a second electric current loop 420.

Furthermore, in addition to the first electric current loop 410 and the second electric current loop 420, a third electric current loop 430 may be formed in the ground radiator according to the third embodiment of the present invention. Herein, the third electric current loop 430 flows through the first capacitor 43 and the second capacitor 47.

As described above, since a resonance occurs in the multi-band due to the multiple electric current loops, an antenna having a multi-band may be configured in the present invention.

Figure 5:
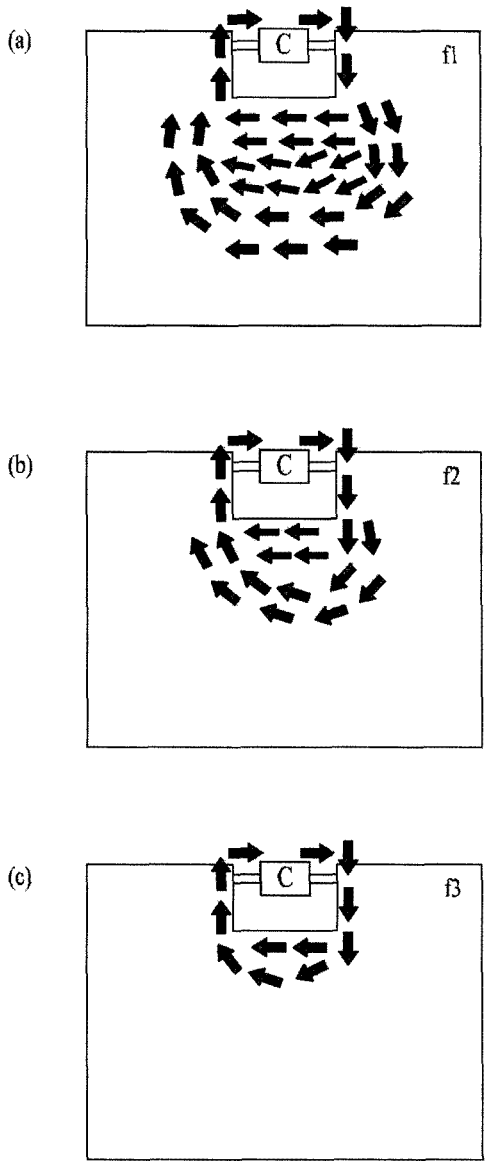
FIG. 5 illustrates an exemplary distribution of electric currents based upon a frequency being fed to the ground radiator.

FIG. 5 illustrates an exemplary distribution of electric currents based upon a frequency being fed to the ground radiator.

FIG. 5(*a*) shows the distribution of electric current when a lowest frequency is being fed. FIG. 5(*b*) shows the distribution of electric current when an intermediate frequency is being fed. And, FIG. 5(*c*) shows the distribution of electric current when a highest frequency is being fed. Referring to FIG. 5, it is apparent that the distribution of the electric currents becomes wider in accordance with the feeding of a lower-level frequency.

Referring to FIG. 5, even though it is provided that the capacitance of the capacitor is fixed, the electric current distribution varies with respect to the level of the frequency that is being fed. Eventually, the inductance provided by the ground may also vary, and a resonance may occur in a wider band. Therefore, the present invention may be known to be operated as an antenna radiator having the broadband characteristic.

The antenna is configured of an antenna radiator for RF signal radiation as well as a feeding circuit (or feeding scheme) for feeding the signal that is to be radiated. Hereinafter, an antenna that is configured of a combination of the ground radiator and the feeding circuit according to various embodiments of the present invention will now be described in detail.

Figure 6:
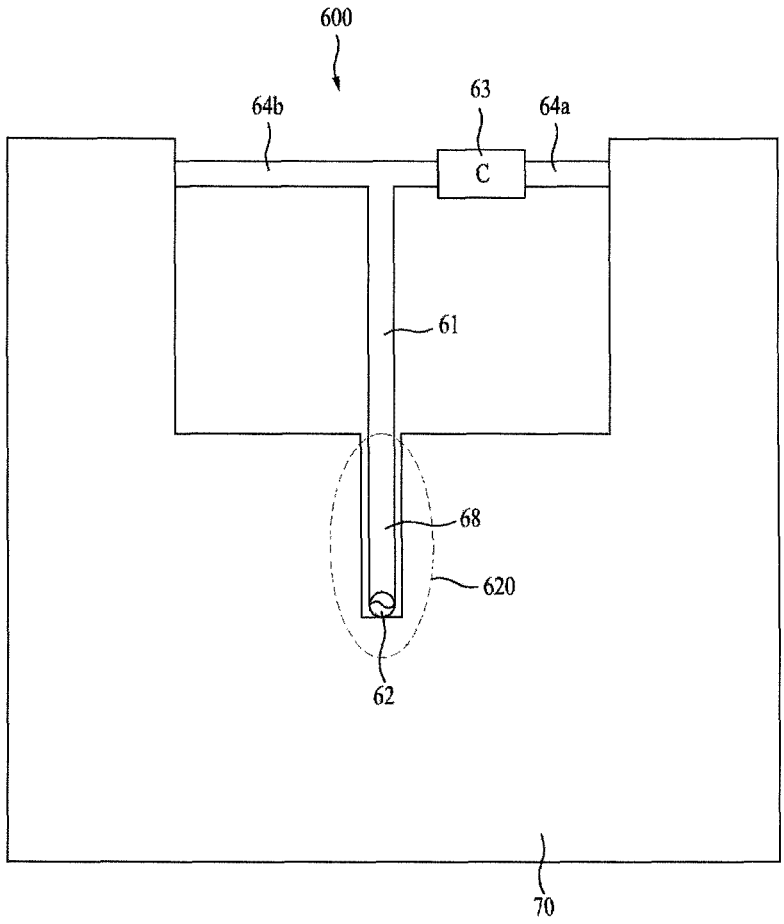
FIG. 6 illustrates a structural view of a ground antenna, wherein a ground radiator and a feeding circuit are configured as a single body, according to the present invention.

FIG. 6 illustrates a structural view of a ground radiation antenna, wherein a ground radiator and a feeding circuit are configured as a single body, according to the present invention.

Referring to FIG. 6, the ground radiation antenna using the antenna radiator according to an embodiment of the present invention includes a feeding part 620 configured of a feeding source 62 and a feeding transmission line 68, a ground 60, a first conductor line 61, a second conductor line 64*a*, a capacitive element 63, and a third conductor line 64*b*.

The feeding part 620, the first conductor line 61, the capacitive element 63, and the second conductor line 64*a* collectively operate as a feeding circuit for exciting the antenna radiation, so that radiation of an RF signal can occur through the antenna radiator. Additionally, the first conductor line 61, the capacitive element 63, and the second conductor line 64*a* operate in collaboration (or collectively) as an antenna radiator-forming circuit, which enables the RF signal to be actually radiated.

More specifically, in the antenna according to the embodiment of the present invention, the first conductor line 61, the capacitive element 63, and the second conductor line 64*a* correspond to a portion of the feeding circuit of the antenna and may also correspond to a portion of the radiator-forming circuit.

Meanwhile, the third conductor line 64*b* is added in order to facilitate impedance matching.

According to the embodiment of the present invention, it is preferable that the capacitive element corresponds to a lumped circuit element, such as a chip capacitor. However, in addition to the chip capacitor, a capacitive element having a general capacitive structure may also be used in the first embodiment of the present invention. Furthermore, the capacitive element may either be configured of a single capacitor, or may be configured by connecting two or more capacitors to one another.

Herein, an antenna radiator refers to a unit (or location) wherein RF signal radiation mostly occurs. And, a feeding circuit (or feeding scheme) refers to a circuit for supplying an RF signal in order to operate the ground antenna as the antenna of the user equipment. Therefore, the use of the term "feeding circuit" does not signify that RF signal radiation does not occur at all. Nevertheless, since most of the radiation occurs though the ground radiator, the antenna radiator is referred to as the ground radiator. This principle is equally applied to other embodiments of the present invention.

As described in the embodiment of the present invention, when the radiator according to the present invention is used, an antenna having a simple structure and yielding excellent radiation efficiency may be realized without having to separately configure a radiating element having a complex structure.

Figure 7:
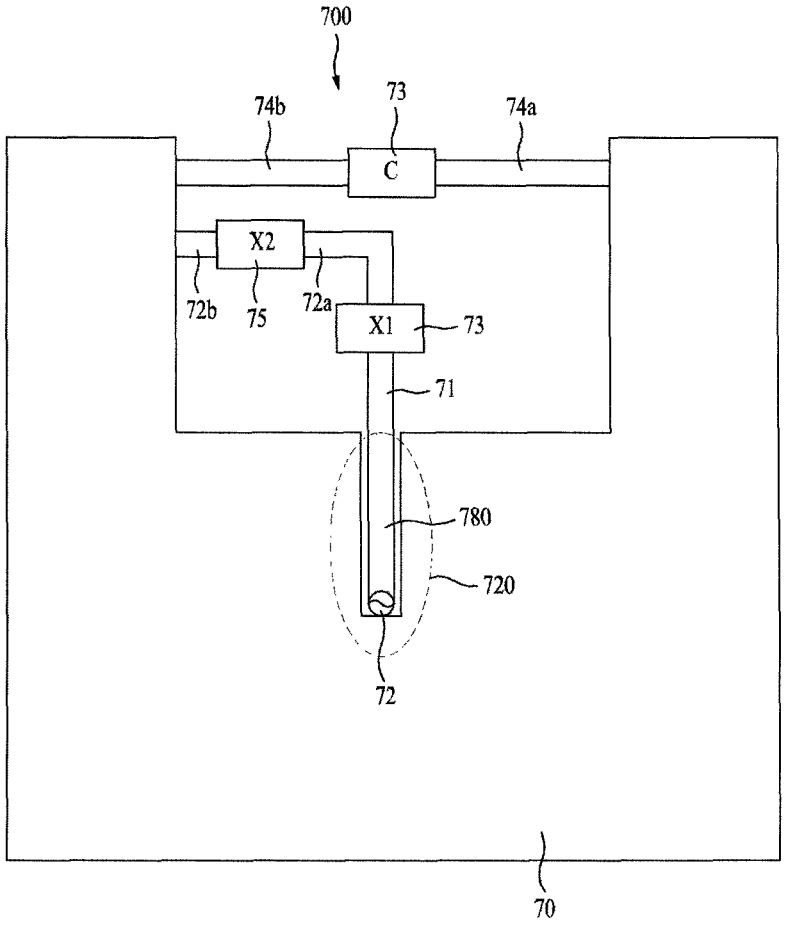
FIG. 7 illustrates an antenna using an antenna radiator according to the present invention.

FIG. 7 illustrates an antenna using an antenna radiator according to the present invention.

Referring to FIG. 7, the antenna using ground radiation according to the present invention includes a feeding part 720 configured of a feeding source 72 and a feeding transmission line 780, a feeding source 72, a ground 70, a first conductor line 71, a first element 73, a second conductor line 72*a*, a second element 75, a third conductor line 72*b*, a capacitive element 77, a fourth conductor line 74*a*, and a fifth conductor line 74*b*.

The ground 70 provides a reference voltage inside a telecommunication device, such as a mobile communication user terminal (or user equipment). Generally, it is preferable that a user terminal ground is formed in a printed circuit board (PCB), wherein circuit devices required for the operation of the user equipment (or terminal) are combined with one another. According to the present invention, in addition to providing the reference voltage, the ground 70 also performs the function of a ground radiator of the antenna. This characteristic is equally applied to the other embodiments of the present invention, which will be described in detail later on.

According to the embodiment of the present invention, the feeding part 720, the first conductor line 71, the first element 73, the second conductor line 72*a*, the second element 75, and the third conductor line 72*b* collectively operate as a feeding circuit for exciting the antenna radiation, so that radiation of an RF signal can occur through the antenna radiator. Additionally, the fourth conductor line 74*a*, the capacitive element 77, and the fifth conductor line 74*b* collectively operate as an antenna radiator-forming circuit, which enables the RF signal to be actually radiated.

More specifically, according to the embodiment of the present invention, the feeding part 720, the first conductor line 71, the first element 73, the second conductor line 72*a*, the second element 75, and the third conductor line 72*b* collectively operate as the feeding circuit, and the fourth conductor line 74*a*, the capacitive element 77, and the fifth conductor line 74*b* collectively operate as a radiating element of the antenna, which radiates the RF signal with respect to the feeding of the feeding circuit.

According to the embodiment of the present invention, the first element 73 may correspond to an inductive element, a capacitive element, or a simple conductive line. Additionally, the second element 75 may also correspond to an inductive element, a capacitive element, or a simple conductive line.

At this point, in case the first element 73 is a capacitive element, the first conductor line 71, the first element 73, the second conductor line 72*a*, the second element 75, and the third conductor line 72*b* may collectively operate as the feeding circuit and may also collectively operate as the radiator-forming circuit. And, the antenna according to the embodiment of the present invention may have the multi-band characteristic.

Figure 8:
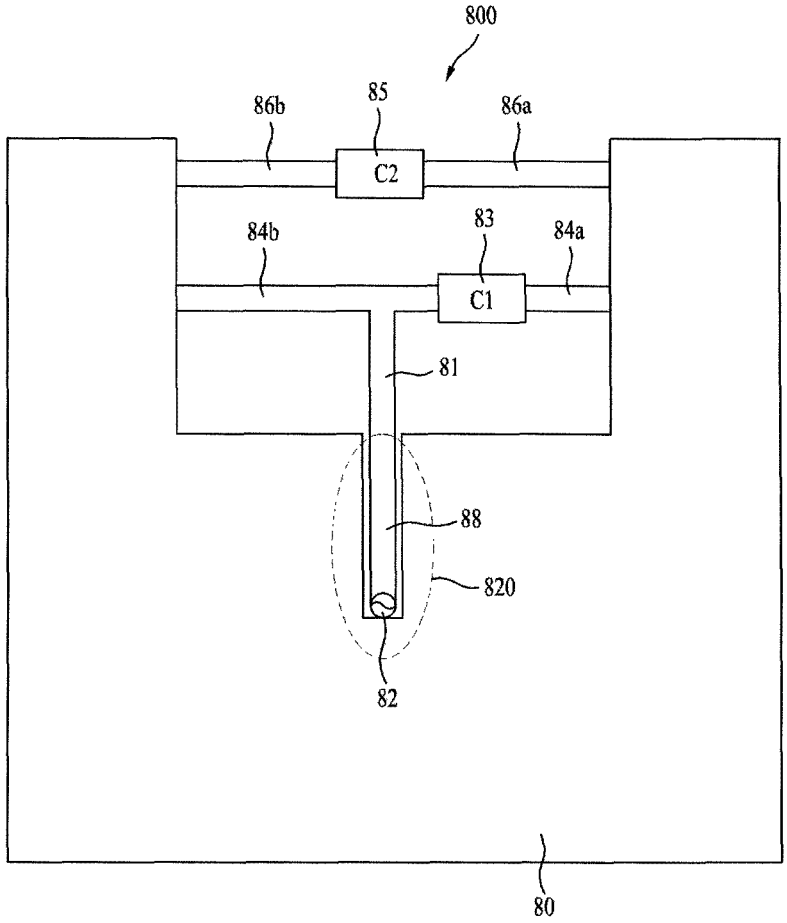
FIG. 8 illustrates a structural view of a ground antenna, wherein a ground radiator and a feeding circuit are separately configured, according to the present invention.

FIG. 8 illustrates a structural view of a ground antenna, wherein a ground radiator and a feeding circuit are separately configured, according to the present invention.

Referring to FIG. 8, the ground radiation antenna using the antenna radiator according to the present invention includes a feeding part 820 configured of a feeding source 82 and a feeding transmission line 88, a ground 80, a first conductor line 81, a second conductor line 84*a*, a first capacitive element 83, a third conductor line 84*b*, a fourth conductor line 86*a*, a second capacitive element 85, and a fifth conductor line 86*b*.

According to the embodiment of the present invention, the feeding part 820, the first conductor line 81, the second conductor line 84*a*, and the first capacitive element 83 collectively operate as a feeding circuit for exciting the antenna radiation, so that radiation of an RF signal can occur through the antenna radiator. Additionally, the first conductor line 81, the first capacitive element 83, and the second conductor line 84*a* collectively operate as an antenna radiator-forming circuit, which enables the RF signal to be actually radiated.

More specifically, in the antenna according to the embodiment of the present invention, the first conductor line 81, the first capacitive element 83, and the second conductor line 84*a* correspond to a portion of the feeding circuit of the antenna and may also correspond to a portion of the antenna radiator-forming circuit.

Meanwhile, the third conductor line 84*b* is added in order to facilitate impedance matching.

Furthermore, the fourth conductor line 86*a*, the second capacitive element 85, and the fifth conductor line 86*b* collectively operate as another antenna radiator-forming circuit.

Therefore, a first radiator-forming circuit, which operates as both the antenna radiator and the feeding circuit, and a second radiator-forming circuit, which operates only as the antenna radiator-forming circuit, both exist in the ground radiator antenna according to the present invention. The antenna according to the embodiment of the present invention shown in FIG. 8 corresponds to the structure of the ground radiator antenna, shown in FIG. 6, further including a antenna radiator-forming circuit. More specifically, according to the embodiment of the present invention, the antenna radiator-forming circuit may be realized to have a structure separated from the feeding circuit.

As described above, when configuring the antenna using a radiator according to the present invention, regardless of whether the radiator and the feeding circuit are formed as a single body, or whether the radiator and the feeding circuit are each formed separately, an antenna having a remarkably simple structure while providing excellent radiation efficiency may be realized, without having to configure a radiating element having a complex structure.

In addition to the above-described embodiments of the present invention, a variety of ground radiation antennae may be realized by combining the radiator according to the present invention with diverse forms of feeding circuits.

The invention claimed is:

1. A ground radiator for an antenna comprising:

a clearance area formed on a circuit board, wherein one part of the clearance area is open and the other part of the clearance area borders a ground area formed on the circuit board, wherein the clearance area and the ground area are formed on a same plane; and a first conductor line formed in the clearance area, both ends of the first conductor line being connected to the ground area, wherein the first conductor line comprises at least one capacitor, the capacitor being a lumped element with a constant value.

2. The ground radiator of claim 1, wherein the capacitor is a chip-capacitor.

3. The ground radiator of claim 1, wherein the clearance area has a rectangular shape.

4. The ground radiator of claim 3, wherein at least one side of the rectangular clearance area is open.

5. The ground radiator of claim 1, wherein the first conductor line is a straight line.

6. A method of manufacturing a ground radiator for an antenna, the method comprising:

forming a ground area on a circuit board;

forming a clearance area on the circuit board, wherein one part of the clearance area is open and the other part of the clearance area borders the ground area, wherein the ground area and the clearance area are formed on a same plane; and forming a first conductor line in the clearance area, both ends of the first conductor line being connected to the ground area, wherein the first conductor line comprises at least one capacitor, the capacitor being a lumped element with a constant value.

7. The method of claim 6, wherein the capacitor is a chip-capacitor.

8. The method of claim 6, wherein the clearance area has a rectangular shape.

9. The method of claim 8, wherein at least one side of the rectangular clearance area is open.

10. The method of claim 6, wherein the first conductor line is a straight line.

11. A ground radiator for an antenna comprising:

a ground area formed on a circuit board;

a clearance area formed within the ground area, wherein the ground area and the clearance area are formed on a same plane and at least one side of the clearance area does not border with the ground area; and a first conductor line formed in the clearance area, both ends of the first conductor line being connected to the ground area, the first conductor line comprising at least one capacitor.

12. A method of manufacturing a ground radiator for an antenna, the method comprising:

forming a ground area on a circuit board;

forming a clearance area within the ground area, wherein the ground area and the clearance area are formed on a same plane and at least one side of the clearance does not border with the ground area; and forming a first conductor line in the clearance area, both ends of the first conductor line being connected to the ground area, the first conductor line comprising at least one capacitor.

* * * * *

UNITED STATES PATENT AND TRADEMARK OFFICE

CERTIFICATE OF CORRECTION

PATENT NO. : 8,648,763 B2
APPLICATION NO. : 13/081104
DATED : February 11, 2014
INVENTOR(S) : Hyeng-cheul Choi et al.

It is certified that error appears in the above-identified patent and that said Letters Patent is hereby corrected as shown below:

On the title page, at Item (30) Foreign Application Priority Data, "20-2010-0043190" should be changed to --10-2010-0043190--.

Signed and Sealed this
Twenty-second Day of April, 2014

Michelle K. Lee

Michelle K. Lee
*Deputy Director of the United States Patent and Trademark Office*